United States Patent [19]

Sheratte

[11] 4,007,123

[45] * Feb. 8, 1977

[54] FIRE RESISTANT FUNCTIONAL FLUID COMPOSITIONS

[75] Inventor: Martin B. Sheratte, Canoga Park, Calif.

[73] Assignee: McDonnell Douglas Corporation, Long Beach, Calif.

[ * ] Notice: The portion of the term of this patent subsequent to Feb. 11, 1992, has been disclaimed.

[22] Filed: Oct. 15, 1974

[21] Appl. No.: 514,389

Related U.S. Application Data

[63] Continuation-in-part of Ser. No. 230,131, Feb. 28, 1972, abandoned, and a continuation-in-part of Ser. No. 449,623, March 11, 1974, Pat. No. 3,935,116.

[52] U.S. Cl. ..... 252/78.5; 252/78.1; 252/46.7

[51] Int. Cl.[2] ..... C10M 3/40; C10M 3/32

[58] Field of Search ..... 252/78, 78.1, 78.5, 252/46.7

[56] References Cited

UNITED STATES PATENTS

| | | | |
|---|---|---|---|
| 2,549,270 | 4/1951 | Watson | 252/78 |
| 2,566,623 | 9/1951 | Moreton | 252/78 |
| 2,636,861 | 4/1953 | Watson | 252/78 |
| 2,659,699 | 11/1953 | George et al. | 252/78 |
| 2,687,377 | 8/1954 | Stewart et al. | 252/78 X |
| 3,723,320 | 3/1973 | Herber et al. | 252/78 |
| 3,730,897 | 5/1973 | McCord et al. | 252/78 |
| 3,730,898 | 5/1973 | McCord et al. | 252/78 |
| 3,795,619 | 3/1974 | Sheratte | 252/78 |
| 3,795,621 | 3/1974 | Sheratte | 252/78 |
| 3,865,743 | 2/1975 | Sheratte | 252/78 |

*Primary Examiner*—Harris A. Pitlick
*Attorney, Agent, or Firm*—Max Geldin

[57] ABSTRACT

A functional fluid composition consisting essentially of (1) a phosphorus compound, preferably a phosphate ester containing at least two alkyl groups such as tributyl phosphate or di-n-butyl phenyl phosphate, alone or particularly in combination with a phosphate ester containing at least two aromatic groups, such as n-butyl diphenyl phosphate or tricresyl phosphate, (2) a polyalkylene glycol material, e.g. a polypropylene glycol ether having a molecular weight ranging from about 600 to about 1200, and particularly a combination of at least two polyalkylene glycol materials, e.g. two polypropylene glycol ethers having substantially different molecular weights, and (3) a small amount of certain halogenated organic selenides or tellurides, preferably a chlorinated aryl selenide such as 4,4′-dichlorodiphenyl diselenide, or a chlorinated selenophene or a chlorinated tellurophene, e.g. tetrachloroselenophene or tetrachlorotellurophene.

25 Claims, No Drawings

FIRE RESISTANT FUNCTIONAL FLUID COMPOSITIONS

This application is a continuation-in-part of my copending applications Ser. No. 230,131, filed Feb. 28, 1972, now abandoned and Ser. No. 449,623, filed Mar. 11, 1974, now U.S. Pat. No. 3,935,116.

This invention relates to functional fluid compositions having improved fire resistance and desirable viscosity characteristics at both high and low temperature, and is especially directed to functional fluid compositions having the above-noted properties, particularly high fire resistance and reduced deleterious effect on non-metallic materials, including reduced swelling effect on rubber, consisting essentially of a phosphorus compound, particularly certain phosphate esters and certain combinations of phosphate esters, a polyalkylene glycol material, such as a polypropylene glycol ether of relatively low to medium molecular weight and particularly combinations of certain polyalkylene glycol materials, and a small amount of a certain halogenated, particularly chlorinated, organic selenide, or a certain selenophene or tellurophene compound, the resulting functional fluids having the above-noted desirable viscosity characteristics without requiring addition thereto of viscosity index improvers, such fluids also having improved thermal and hydrolytic stability and reduced density, as compared to conventional phosphate ester fluids, while otherwise retaining the desirable characteristics and advantages of conventional functional fluids containing chiefly a phosphate ester or mixtures thereof.

Many different types of materials are employed as functional fluids, and functional fluids are utilized in a wide variety of applications. Thus, such fluids have been utilized as electronic coolants, diffusion pump fluids, lubricants, damping fluid, power transmission and hydraulic fluids, heat transfer fluids and heat pump fluids. A particularly important application of such functional fluids has been their utilization as hydraulic fluids and lubricants in aircraft, requiring successful operation of such fluids over a wide temperature range, and fire resistant fluids.

Functional and hydraulic fluids employed in many industrial applications and particularly hydraulic fluids for aircraft must meet a number of important requirements. Thus, such hydraulic fluids particularly for aircraft use, should be operable over a wide temperature range, should have good stability at relatively high temperatures and preferably have lubricating characteristics. In addition to having the usual combination of properties making it a good lubricant or hydraulic fluid, such fluid should also have relatively low viscosity at extremely low temperatures and an adequately high viscosity at relatively high temperatures, and must have adequate stability at the high operating temperatures of use. Further, it is of importance that such fluids be compatible with and not adversely affect materials including metals and non-metals such as elastomeric or rubber seals of the system in which the fluid is employed. It is particularly important in aircraft hydraulic fluids and lubricants that such fluids have as high a fire resistance as possible to prevent ignition if such fluids are accidentally or as result of damage to the hydraulic system, sprayed onto or into contact with surfaces of materials of high temperature. Another important property for application of a hydraulic fluid in aircraft is the provision of a low density fluid to increase pay load.

Hydraulic fluids in commercial jet aircraft are exposed to temperatures ranging from below −40° F. to over 200° F. Within these temperature extremes, it is necessary for the fluid to maintain a reasonably low viscosity when cold, and yet not become too thin when hot. As a general rule, this means that the fluid preferably should have a viscosity of less than 4.200 cs. (centistokes) at −65° F., and maintain a viscosity preferably above 3.0 cs. at 210° F.

Presently available commercial functional or hydraulic fluid base stocks do not possess these viscosity characteristics. Phosphate esters are among the most commonly employed base stocks, of which tributyl phosphate and dibutyl phenyl phosphate are widely used components. Both of the latter phosphates are too thin at high temperatures, and their use alone would result in rapid wear of moving parts. Other phosphate esters, such as tricresyl phosphate, for example, which provide the requisite high temperature viscosity become too thick to be useful at low temperatures. Even mixtures of various phosphate esters such as those noted above do not provide the required viscosity characteristics at both low and high temperatures. Accordingly, it has been the practice to achieve the required wide viscosity range required for aircraft hydraulic fluids by adding to a thin base stock, such as phosphate ester or mixtures thereof, a small proportion, e.g., up to 10%, of a polymeric material such as polyalkyl acrylates or methacrylates, whose solubility characteristics in the base stock are chosen so that the polymeric material thickens the fluid more at high temperatures than at low temperatures, and thus functions as a viscosity index (VI) improver.

However, the chief disadvantage of this method of viscosity improvement is that polymers of the type noted above are generally not stable to the shearing forces encountered in an aircraft hydraulic system, and during use, these large molecules are sheared down to smaller molecules which lose their ability to improve viscosity index. This means that the functional fluid loses viscosity in use and requires addition of polymer to the fluid and eventually, as the detritus from polymeric breakdown accumulates in the fluid and contaminates it, the fluid must be discarded. In addition, of course, employment of a viscosity index improver in the functional fluid, even in the minor amounts pesently employed, substantially increases the cost of the fluid.

Polyalkylene glycol materials such as the copolymer of ethylene oxide and 1,2-propylene oxide, having high molecular weight up to 15,000 to 20,000, have been employed as soluble organic polymeric thickeners in water based hydraulic fluids containing a water soluble glycol such as ethylene glycol, as the basic component, as disclosed in U.S. Pat No. 2,602,780. However, such high molecular weight polyalkylene glycol materials have not heretofore been employed as a base stock component in essentially non-aqueous fire resistant phosphate ester based hydraulic fluids of the type according to the present invention.

U.S. Pat. No. 2,469,285 to White discloses a hydraulic pressure transmitting fluid such as a brake fluid, consisting essentially of tricresyl phosphate, along with solvents or diluents, such as a polymerized glycol and/or an aliphatic ether of a polyglycol, singly or in combination. However, such a fluid containing only tricresyl phosphate as the so-called lubricating base of the fluid, is too thick to be used as a hydraulic fluid for aircraft, at low temperatures ranging from −40° F. to −65° F., even in the presence of the glycol materials employed as solvents or diluents in such fluid. Thus, as noted in the patent, the viscosity at −40° F., of representative examples of fluids according to this patent are about 9,000 cs. and about 19,500 cs., which is substantially above the required viscosity for hydraulic fluids in commercial jet aircraft exposed to such low temperatures, such fluids preferably having a viscosity of less than 4,200 cs. at the much lower temperature of −65° F. as noted above.

U.S. Pat. No. 2,801,968 to Furby et al is directed to a jet turbine lubricant having as the main component a glycol ether employment in an amount of 90 to 98%, and which includes an antiwear additive in the form of a phosphate ester employed in minor proportions of only 0.5 to 5%. This composition is not a phosphate ester based hydraulic fluid, and it is noted that it is necessary to have the lubricant of this patent relatively thick because of the high operating temperatures of 550 to 650° F. of the lubricant, it being only necessary to be able to start the engine at low temperatures. Thus, in representative examples of this patent it is noted that at −65° F. the compositions of the patent have a viscosity ranging from almost 13,000 to 19,000 cs. Although such a high viscosity in permissible for use of the composition of the patent as a jet lubricant, that is to supply a film of lubricant to the moving parts of the jet engine, such high viscosities would render the composition of Furby et al entirely unacceptable and inoperative to function as a hydraulic fluid continously at such low temperatures, for example at −65° F. since as noted above a hydraulic fluid for successful operation of commercial jet aircraft at −65° F. preferably should have a viscosity of less than 4,200 cs. at such temperature, while at the same time having sufficiently high viscosity at high temperatures also to continously operate at the higher temperatures.

U.S. Pat. No. 2,839,468 to Stewart et al. has substantially the same disclosure as the above-noted Furby et al U.S. Pat. No. 2,801,968

U.S. Pat. No. 3,468,802 to Nail discloses hydraulic fluid compositions containing a phosphate ester as base stock component and discloses that various viscosity index improvers, including high molecular weight polyalkylene glycols, can be employed in minor proportion of from about 0.2 to about 12% by weight. It is noted that such high molecular weight polyalkylene glycol viscosity index improvers are characterized by having a high viscosity in the range of about 1,400 to 23,000 cs. at 100° F.

U.S. Pat. No. 3,513,097 to Langenfeld discloses use of a wide variety of base stocks in functional fluid compositions, including esters and amides of phosphorus, among other types of base stocks. The patentee notes that the base stocks can also contain other fluids derived from coal products, for example alkylene oxide-type polymers, e.g. propylene oxide polymers. There is no disclosure or suggestion in this patent, however, of the combination of such alkylene oxide polymers with any specific types of base stock components, such as phosphate esters.

Further, while many functional and hydraulic fluid compositions have been developed, many of these compositions do not have the requisite high fire resistance desired particularly for use of such functional fluid or hydraulic fluid compositions in modern high speed aircraft or in a hydraulic system of a high temperature jet-turbine power plant of a jet-turbine aircraft.

Thus, as an illustration, many functional and hydraulic fluids have an autoignition temperature ranging from about 450° to about 750° F. It is particularly desirable to increase the auto-ignition temperature of such functional and hydraulic fluids to the range of about 800° to about 1,000° F.

In U.S. Pat. No. 3,730,897, to McCord et al, there is disclosed the improvement of the fire resistance of functional or hydraulic fluids, such as phosphate ester base stocks, by incorporation of a small amount of an aryl selenide compound, preferably a chlorinated aryl selenide, e.g. ethyl p-chlorophenyl selenide, into such phosphate ester base stock. In U.S. Pat. No. 3,730,898 to McCord et al there is disclosed the incorporation of a small amount or a selenophene or tellurophene compound, preferably a chlorinated selenophene or a chlorinated tellurophene, e.g. tetrachloroselenophene or tetrachlorotellurophene, into the same type of functional fluid base stock, such as phosphate ester, for the same purpose. However, in neither patent is there any disclosure of the use or effect of such additives in a hydraulic fluid containing a polyalkylene glycol material as a base stock component.

It is an object of this invention to provide a functional fluid which is particularly useful as an aircraft hydraulic fluid and which has improved fire resistance and requisite viscosity characteristics over a wide temperature range, and which has the advantage of not requiring incorporation of viscosity index improvers, while at the same time having other improved and other requisite properties for a good hydraulic fluid, including low density, freedom from corrosivity and wear on metallic parts, and reduced deleterious effect on non-metallic materials, e.g. reduced rubber swell, and having substantially reduced cost as compared to presently available aircraft hydraulic fluids, particularly those based essentially on phosphorus esters alone as the base stock component. Hence it is a particular object to replace such presently employed phosphorus ester base stock fluids, with functional fluids or blends containing base stock components or combinations thereof, in addition to phosphorus ester or phosphate components, and certain additives, which confer on the functional or hydraulic fluid, high fire resistance, good viscosity and density characteristics, and other improved properties, while substantially reducing the cost of the fluid.

The above objects are achieved according to the present invention by the provision of a functional fluid, particularly valuable as a hydraulic fluid for aircraft, comprising basically a mixture of a phosphorus compound, particularly a phosphate ester containing at least two alkyl or alkoxyalkyl groups, hereinafter termed an "aliphatic" phosphate, a polyalkylene glycol material, particularly a polypropylene glycol ether of relatively low to medium molecular weight, and a small amount of an aryl selenide, preferably a halogenated, particularly chlorinated, aryl selenide, or a selenophene or tellurophene compound, preferably a halogenated, e.g. chlorinated derivative thereof, as defined in detail hereinafter. The phosphorus compound, e.g. phosphate ester, polyalkylene glycol material, and selenide or telluride additive are utilized preferably in the amounts or proportions set forth hereinafter, in order to obtain the desirable properties of the functional fluid noted above.

It has been found that the incorporation of a phosphate ester containing at least two aromatic groups, e.g. diphenyl-n-butyl phosphate, hereinafter termed an "aromatic" phosphate, particularly in certain amounts noted below, in combination with a phosphate ester containing at least two alkyl groups, e.g. tributyl phosphate or di-n-butyl phenyl phosphate, the aliphatic phosphate, provides additional advantages. In the first place, the presence of the phosphate ester containing at least two aromatic groups has been found unexpectedly to increase or improve the AIT (autoignition temperature) characteristics of the resulting fluid or blend, over the fluid having only a phosphate ester or esters containing at least two alkyl groups, that is, the aliphatic phosphate. This is particularly noticeable in blends containing an aliphatic phosphate and including polyglycols or polyglycol ethers such as polyethylene glycol or polypropylene glycol mono- or di-butyl ethers. Thus, the use of polyglycols or polyglycol ethers as components of phosphate ester based hydraulic fluids causes a loss of flammability resistance, particularly in AIT. This can be overcome to some extent by a suitable choice of phosphate esters, particularly the above-noted combination of aromatic and aliphatic phosphates. Thus, in a functional fluid containing e.g. about 75% tributyl phosphate, and about 25% polyalkylene glycol material, by replacing a portion of such tributyl phosphate, e.g. 25% by weight of the fluid, with diphenyl octyl phosphate, the AIT of the resulting blend can be raised as much as 100° F. or more over the fluid containing only the tributyl phosphate. However, generally a mixture or blend of such combination of aromatic and aliphatic phosphates, together with polyalkylene glycol material, still has a lower fire resistance and AIT than a similar mixture without the glycol material.

A further unexpected advantage of the presence of the aromatic phosphate together with the aliphatic phosphate is a marked decrease in the effect of such fluid blend on non-metallic materials, particularly elastomers such as rubber, as compared to fluids containing only an aliphatic phosphate or phosphates. Thus, the amount of rubber swell occuring on contact of such fluid blend of aromatic and aliphatic phosphates with rubber materials such as rubber seals, is markedly reduced as contrasted to the amount of rubber swell produced by contact with fluids containing only aliphatic phosphates. Hence the presence of such aromatic phosphates in the above fluid blends causes a significant improvement in rubber compatibility. This is quite remarkable, since it is known, as pointed out in above U.S. Pat. No. 2,469,285 to White, that aromatic compounds are noted for their capacity to cause rubber swelling.

However, the presence of aromatic phosphates, such as tricresyl phosphate, in blends together with an aliphatic phosphate, such as tributyl phosphate causes the blend to be less responsive to the viscosity improving characteristics of the polyalkylene glycol component. Thus, it has been found advantageous to incorporate at last two different polyalkylene glycol components, that is at least two polyalkylene glycol materials, preferably at least two polyalkylene glycol ethers, that is, monoethers and/or diethers, having substantially different molecular weights, in the fluid or blend containing both the above-noted aromatic and aliphatic phosphates. The result is that the fluid blend can be more readily designed or tailored so that it has the above-noted desirable low and high temperature viscosity characteristics.

It has been found unexpectedly that by addition of a small amount of a halogenated, preferably chlorinated, aryl selenide, e.g. 4,4′-dichlorodiphenyl diselenide as described in above U.S. Pat. No. 3,730,987, or a selenophene or tellurophene compound, preferably a halogenated, e.g. chlorinated, derivative thereof, such as tetrachloroselenophene, as described in above U.S. Pat. No. 3.730,898, to the above-noted mixture or blend including polyalkylene glycol material and aromatic and aliphatic phosphates, the resulting mixture can have an increased and improved fire resistance or AIT comparable to that of the same mixture without the glycol material. Such improved fire resistance can be attained without the sacrifice of any of the other important characteristics of the fluid. Thus, the presence of such additives in the hydraulic or functional fluids of the present invention have no adverse effect on low temperature viscosity of the functional fluids hereof, particularly when employed as hydraulic fluids in aircraft, do not adversely affect the thermal stability of the fluid, and are of relatively low cost.

Thus, the functional fluids produced according to the invention can be blended as noted above to have a fire resistance greater than the fire resistance of presently employed commercially available hydraulic fluids, and at the same time to have suitably low viscosity at temperatures below −40° F., and down to −65° F., and suitably high viscosity at high temperature of 210° F., and above, and this can be accomplished without incorporating viscosity index improver. By avoiding the necessity for a viscosity index improver, the functional fluids of the invention do not suffer from the disadvantage noted above, namely, the deterioration of such polymeric additives used for viscosity improvement, and accumulation of molecular debris, leading to a shortening of the useful life of the fluid. Hence the functional fluids of the present invention have a longer period of usefulness, providing economic advantages including the avoidance of the high cost of the viscosity index improver and the employment of relatively low cost polyalkylene glycol ethers or diethers, in place of a substantial portion of the phosphate ester generally employed in presently available phosphate based aircraft hydraulic fluids.

Also, the functional fluid compositions and blends of the present invention have improved thermal and hydrolytic stability compared with the phosphate ester based fluids currently in use, contributing to a long useful life for the fluid. In addition, the functional fluids according to the present invention have low densities of the order of 1.0 or less, an important property for aircraft hydraulic fluids. The above advantages can be achieved while at the same time improving the flammability characteristics over phosphate ester-type hydraulic fluids currently in use. Also, the functional fluids according to the invention have freedom from wear and deterioration with respect to the metallic and nonmetallic components, and the pumps of hydraulic fluid systems, which compare favorably with these characteristics for phosphate type base stock hydraulic fluids presently commercially employed.

Further, in addition to their valuable application as hydraulic fluids for aircraft hydraulic systems, the fluids according to the invention have important application as a hydraulic or functional fluid in industrial and marine fields, particularly in industrial turbine systems.

One of the essential components of the functional fluids according to the invention is a phosphorus compound selected from the group consisting of certain phosphate esters and amides of an acid of phosphorus, or mixtures thereof.

The basic aliphatic phosphate ester employed in the functional fluid according to the invention has the general formula:

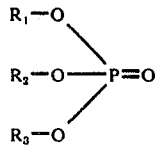

where $R_1$ and $R_2$ each are alkyl, both straight chain and branched chain of from about 3 to about 10 carbon atoms such as n-propyl, n-butyl, n-amyl, n-hexyl, isopropyl, isobutyl, and the like, and alkoxyalkyl having from about 3 to about 8 carbon atoms such as methoxy methyl, methoxy ethyl, ethoxy ethyl, methoxy propyl, and the like, and $R_3$ can by alkyl or alkoxyalkyl as defined above, or aryl such as phenyl and naphthyl, alkaryl such as cresyl, xylyl, ethyl phenyl, propyl phenyl, isopropyl phenyl, and the like, said aryl and alkaryl radicals preferably containing from 6 to about 8 carbon atoms.

Examples of such aliphatic phosphates are the trialkyl phosphates having alkyl groups which are either straight chain or branched chain with from about 3 to about 10 carbon atoms, such as n-propyl n-butyl, n-amyl and n-hexyl, particularly tri-n-butyl phosphate, tri(2-ethyl hexyl) phosphate and triisononyl phosphate, the straight chain alkyl groups preferably containing from 4 to 6 carbon atoms.

Other examples of such aliphatic phosphate esters are the dialkyl aryl phosphates in which the alkyl groups are either straight chain or branched chain and contain from about 3 to about 10 carbon atoms, such as n-propyl, n-butyl, n-amyl, n-hexyl, isopropyl, isobutyl, isoamyl, and the aryl radicals have from 6 to 8 carbon atoms and can be phenyl, cresyl, or xylyl, particularly dialkyl phenyl phosphates including dibutyl phenyl phosphate, butyl amyl phenyl phosphate, butyl hexyl phenyl phosphate, butyl heptyl phenyl phosphate, butyl octyl phenyl phosphate, diamyl phenyl phosphate, amyl hexyl phenyl phosphate, amyl heptyl phenyl phosphate, and dihexyl phenyl phosphate.

In the above-noted preferred embodiment, the basic phosphate ester also includes an aromatic phosphate in combination with the above aliphatic phosphate. Such aromatic phosphate has the general formula:

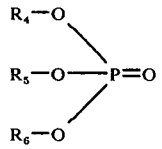

Where $R_4$ and $R_5$ are each aryl or alkaryl as defined above, and $R_6$ can be arly or aralkyl, or alkyl or alkoxyalkyl, as defined above, except that such alkyl can contain from about 3 to about 20 carbon atoms, as illustrated below.

Examples of such aromatic phosphates are triaryl phosphates in which the aryl radicals of such phosphates have from 6 to 8 carbon atoms, that is, may be phenyl, cresyl or xylyl, and in which the total number of carbon atoms in all three of the aryl radicals is from 18 to 24, and preferably wherein the three radicals include at least one cresyl or xylyl radical. Examples of such phosphates include triphenyl, tricresyl, trixylyl, phenyl dicresyl, and cresyl diphenyl phosphates.

Examples of other phosphates also termed herein aromatic phosphates are alkyl diaryl phosphates in which the aryl radicals of such phosphates may have from 6 to 8 carbon atoms and may be phenyl, cresyl or xylyl, and the alkyl radical may have from about 3 to about 20 carbon atoms, examples of which are given above. Examples of te alkyl diaryl phosphates include butyl diphenyl, amyl diphenyl, hexyl diphenyl, heptyl diphenyl, octyl diphenyl, 6-methyl heptyl diphenyl, 2-ethylhexyl diphenyl, decyl diphenyl, decyl dicresyl, tridecyl diphenyl, butyl phenyl cresyl, amyl phenyl xylyl, and butyl dicresyl phosphates.

The above aliphatic and aromatic phosphate esters which can be employed generally are normally liquid between about −65° F. and 210° F., except for triphenyl phosphate. Preferably, the above-noted trialkyl phosphates such as tributyl phosphate or tri-n-hexyl phosphate are employed as the basic aliphatic phosphate, as such phosphates are particularly effective in achieving low viscosity at low temperature. However, the above-noted dialkyl aryl phosphates such as dibutyl phenyl phosphate, also can be employed as the aliphatic phosphate, and such phosphate can be employed in combination with a trialkyl phosphate such as tributyl phosphate.

The aromatic phosphate preferably employed in combination with the basic aliphatic phosphate component in formulating the above-noted blends, are triaryl phosphates as illustrated above, e.g. tricresyl phosphate, particularly in combination with the above-noted trialkyl phosphates, e.g. tributyl phosphate. However, the above-noted alkyl diaryl phosphate such as butyl diphenyl phosphate or octyl diphenyl phosphate or tridecyl diphenyl phosphate also can be employed, particularly in combination with the above-noted trialkyl phosphate. Mixtures of aromatic phosphates also can be employed as the aromatic phosphate ester component.

Further, a mixture of three of the above aliphatic and aromatic phosphates can be used, e.g. a mixture of dibutyl phenyl, tributyl and triphenyl phosphates, or a mixture of tributyl, trihexyl and butyl diphenyl phosphates. Since triphenyl phosphate is a solid at ambient temperature, it is generally employed in combination with a liquid aliphatic phosphate in sufficient amount to maintain the combination liquid over the desired temperature range of operation of the fluid.

Another class of phosphorus compounds which can be employed as a base stock component according to the invention are the amides of acids of phosphorus, e.g., amido phosphates, including the mono-, di- and triamides of an acid of phosphorus, an example of which is phenyl N-methyl-N-n-butyl-N′-methyl-N′-n-butyl phosphoro-diamidate. Additional examples are m-cresyl-p-cresyl -N,N-dimethyl-phosphoroamidate, -di-m-cresyl-N,N-dimethyl-phosphoroamidate, di-p-cresyl-N,N-dimethyl phosphoroamidate, phenyl-N,N-dimethyl-N′,N′-dimethylphosphorodiamidate, N-methyl-N-butyl-N'-N''-tetramethylphosphorotriamidate, N,N'-di-n-propyl-N''-dimethyl- phosphoro-triamidate.

The second essential component of the functional fluid according to the invention is a polyalkylene glycol material. The polyalkylene glycol materials employed are compatible with the above-noted phosphorus compounds, particularly the phosphate esters.

Although polyalkylene glycols, e.g. polypropylene glycol, can be employed, the preferred polyalkylene glycol materials are those in which one or both of the terminal hydroxy groups have been modified to form ether groups, providing mono- or diether derivatives, or combinations thereof. Thus, the most desirable glycol materials for purposes of the invention are the monoethers and diethers. Particularly satisfactory materials have been found to be the monomethyl ether of polypropylene glycol, the copolymer of ethylene oxide and propylene oxide, monobutyl ether, and the butyl, methyl diether or polypropylene glycol.

The polyalkylene glycol materials employed in the invention composition preferably are substantially hydrophobic materials. It is preferred not to employ those polyalkylene glycol materials that are to any significant extent water miscible and which would accordingly tend to dissovle water at one temperature and crystallize water out at lower temperatures. The molecular weight of the glycol materials can range from about 500 to about 25,000. However, in order to maintain as low a viscosity of the functional fluid as possible at low temperatures, the glycol materials employed should be of low to medium molecular weight, and accordingly should have a molelcular weight ranging from about 500 to about 2,000, preferably from about 600 to about 1,200. Also, it is desirable that the polyalkylene glycol component employed be of a type which tends to supercool and to maintain a low viscosity at temperatures down to about −65° F.

However, as previously noted, where the preferred blend of aromatic and aliphatic phosphates is employed, it has been found advantageous to incorporate two or more glycol materials of the types described above, such glycol materials having substantially different molecular weights. Thus, it has been found most desirable to employ a combination of glycol material, preferably an ether, having a low to medium molelcular weight, as defined above, with a high molelcular weight glycol material, preferably an ether, the latter material having a molecular weight above about 2,000, generally ranging from about 3,000 to about 25,000.

The ether end groups which preferably are present on the polyalkylene glycol materials are preferably oxyalkyl groups, the alkyl radicals of which can range from 1 to about 8 carbon atoms in length. The longer chain alkyl groups having in excess of 4 carbon atoms, e.g. pentyl, hexyl, heptyl and octyl, are not preferred because polyalkylene glycol ethers of this type have increased viscosity. It is preferred to employ one or more end alkyl groups in the polyalkylene glycol mono- or diether, which have from 1 to 4 carbon atoms. Thus, preferred end alkyl groups are, for example, methyl, ethyl, n-propyl, isopropyl, n-butyl, isobutyl, and the like. It is often desirable that where a diether is employed, one of the end alkyl groups be a methyl or an ethyl radical, while the other end alkyl group of the diether be, for example, a propyl or butyl radical.

The alkylene groups of the polyalkylene glycol material can be an ethylene or propylene group, or mixtures thereof, that is, copolymers containing ethylene and propylene groups. The propylene polymers and ethylene-propylene copolymerss, that is, copolymers of ethylene oxide and propylene oxide, are preferred over the ethylene polymers, because of the increased water solubility of the ethylene polymers.

Particularly satisfactory polyalkylene glycol materials for purposes of the invention are the n-butyl methyl, n-butyl ethyl, isobutyl ethyl, n-propyl ethyl and isopropyl ethyl diethers of polypropylene glycol, the monomethyl ether of polypropylene glycol and the copolymer of ethylene oxide and propylene oxide, monobutyl ether.

The preferred polyalkylene glycol materials employed in the invention composition can be produced in known manner from the 1,2-alkylene glycols. Thus, for example, polypropylene glycol materials are prepared by reacting 1,2-propylene oxide and the corresponding alkylene glycol to form poly-1,2-propylene glycol derivatives, and one or both terminal hydroxy groups can be removed to provide the above-noted ether groups, either during or after polymerization. The term "polypropylene glycol" employed in the specification and claims is intended to denote and include the above-noted poly-1,2-propylene glycol derivatives.

As noted above, mixtures of the above polyalkylene glycol materials, e.g. mixtures of polypropylene glycol mono and/or diethers can be used, or mixtures of two copolymers of ethylene oxide and propylene oxide, monobutyl ether, of substantially different molecular weights.

The phosphorus compound, e.g. phosphate ester, is employed in amounts sufficient particularly to provide good fire resistance or flammability characteristics of the functional fluid. Further, the phosphorus compound and glycol material are present in amounts such that the functional fluid composition has a viscosity at −65°F. of not greater than about 6,000 cs., preferably not greater than about 4,200 cs., and a viscosity at 210° F. of not less than 2.25 cs., preferably not less than about 3.0 cs. Generally, the phosphorus compound, e.g. phosphate ester, or a mixture thereof, is employed in an amount ranging from about 15 to about 90%, preferably about 15 to about 70%, by weight of the functional fluid composition. When employing the above-noted preferred combination of aliphatic and aromatic phosphates, the aliphatic phosphate can be present in an amount ranging from about 10 to about 80%, preferably about 10 to about 60%, and the aromatic phosphate can be present in an amount ranging from about 5 to about 75%, preferably about 5 to about 40% , by weight of the composition. It has often been found desirable to employ a larger amount of the aliphatic phosphate as compared to aromatic phosphate, e.g. a ratio of from 3:2 to 8:1 of aliphatic to aromatic phosphate. However, in some instances a larger amount of aromatic phosphate to aliphatic phosphate can be employed.

The amount of polyalkylene glycol material, e.g. polypropylene glycol monoether or diether, which can be employed separately or in admixture can range from about 9 to about 84%, preferably about 10 to about 70%, by weight of the functional fluid composition. Compositions containing approximately equal weight proportions of the phosphorus compound or phosphorus ester, and polyalkylene glycol material, for example, have been found quite effective. When mixtures of polyalkylene glycol materials are used, a low to medium molecular weight glycol material can be used in an amount ranging from about 8% to about 65%, preferably about 10 to about 40%, and a glycol material of high molecular weight in an amount ranging from about 2 to about 25%, preferably about 4 to about 15%, by weight of the composition. In such mixture of glycol materials, generally the polyalkylene glycol material of low to medium molecular weight is employed in larger amount than the glycol material of high molecular weight, e.g. in a ratio of 3:2 to 5:1 of the former to the latter.

In any event, the minimum above-noted proportions of at least 15% phosphorus compound, e.g. phosphate ester or a mixture thereof, and at least 9% of the polyalkylene glycol material, or a mixture thereof, by weight, are present in the functional fluid. It will be noted further that when a mixture or combination of phosphate esters is employed, as described above, a single glycol material can be employed, but preferably a mixture thereof, as described above, is used. When only a single glycol material is used, it is preferred to employ the medium to low molecular weight glycol material defined above.

Fire resistance or autoignition temperature of the functional fluid composition is improved according to the invention by addition to such composition of a small amount of certain selenium compounds, in the form of certain aryl selenides and diselenides, especially chlorinated phenyl selenides and diselenides such as 4,4'-dichlorodiphenyl diselenide and ethyl p-chlorophenyl selenide, as described in above U.S. Pat. No. 3,730,897 of McCord et al. Alternatively, such fire resistance is improved according to the invention, by incorporation into the functional fluid of a small amount of the selenophenes or tellurophenes, described in above U.S. Pat. No. 3,730,898 of McCord et al.

Effective selenium compounds, that is aryl selenides, for use as additives in functional hydraulic fluids to reduce flammability and increase autoignition temperature of the fluid, according to the invention, have the formula ArSeR, where Ar is a member selected from the group consisting of aryl and substituted aryl including a substituent selected from the group consisting of alkyl, halogen, alkoxy, aryloxy, amino and dialkylamino, and R is a member selected from the group consisting of unsubstituted and substituted alkyl, aryl and aryloxy, including a substitutent selected from the group consisting of halogen, amino and dialkylamino; and SeAr', where Ar' has the same definition as Ar above, and Ar and Ar' are the same or different.

Thus, Ar and Ar' can be phenyl, naphthyl, anthranyl, and the like, and such aryl groups can contain alkyl substituents such as methyl, ethyl, propyl, butyl, and branched chain alkyls such as isopropyl and isobutyl, and the like, halogen atoms such as chlorine and bromine, alkoxy such as methoxy, ethoxy, propoxy, and the like, aryloxy such as phenoxy and naphthoxy, amino and dialkylamino such as dimethylamino, diethylamino, and the like, such alkyl groups containing from 1 to about 10 carbon atoms. R can be alkyl such as methyl, ethyl, propyl, isopropyl, butyl, isobutyl, and the like, of from 1 to about 10 carbon atoms, aryl such as phenyl, naphthyl, and the like, aryloxy such as phenoxy and napththoxy, and substituted alkyl, aryl and aryloxy radicals containing substituents such as halogen, e.g., chlorine and bromine, amino and dialkylamino such as dimethylamino and diethylamino, and the like, such alkyl groups containing from 1 to about 10 carbon atoms.

The preferred aryl selenides according to the invention are those selected from the group having the general formulae:

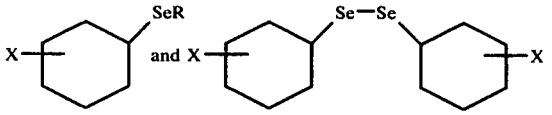

where X is selected from the group consisting of H, alkyl, both straight chain and branched chain and having 1 to about 10 carbon atoms, such as methyl, ethyl, propyl, butyl, isopropyl, pentyl, and the like, halogen such as chlorine and bromine, alkoxy such as methoxy, ethoxy, propoxy, isopropoxy, butoxy, isobutoxy, amino and dialkylamino such as dimethylamino, diethylamino, and the like, and R is alkyl of from about 1 to about 12 carbon atoms, both straight and branched chain, such as methyl, ethyl, propyl, isopropyl, butyl, isobutyl, pentyl, hexyl, and the like.

Compounds which have been found particularly effective are the halogenated, e.g., chlorinated or brominated aryl selenides especially the chlorinated aryl selenides, that is, selenides of the formulae noted immediately above, where X is halogen such as chlorine. The aryl nuclei of the above-noted formulae each can contain one or more of the X, e.g., chloro or bromo, substituents, such as one, two or three such halogen, e.g., chlorine, atoms on each of the phenyl nuclei. The most desirable chlorinated selenides of these types have been found to be ethyl p-chlorophenyl selenide and 4,4'-dichlorodiphenyl diselenide. Other exemplary chlorinated aryl selenides having a structure as defined by the above formulae include methyl p-chlorophenyl selenide, ethyl and propyl o-chlorophenyl selenides, methyl and ethyl 2,4 dichlorophenyl selenides, ethyl 2,4,6,-trichlorophenyl selenide, 2,2' dichlorodiphenyl diselenide, 2,4,2',4'-tetrachloro diphenyl diselenide and 2,4,6,2',4'6'-hexachloro diphenyl diselenide. Brominated analogues corresponding to the above specific examples of the chlorinated selenides and diselenides can be employed.

Effective selenophene and tellurophene compounds for use as additive in the functional or hydraulic fluids hereof to reduce flammability and increase autoignition temperature of the fluid, according to the invention are the 5-membered unsaturated selenium and tellurium heterocyclic compounds having the general formula:

I

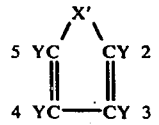

where X' is Se or Te, and Y is H or halogen such as Cl or Br.

Thus, specific examples of selenium and tellurium compounds within the above definition which can be employed include unsubstituted selenophene and tellurophene, wherein all of the Y's above are hydrogen.

The halogenated selenophenes and tellurophenes, particularly the chlorinated derivatives wherein at least one Y is halogen, e.g. chlorine or bromine, including both the partially halogenated and especially the completely halogenated, selenophenes and tellurophenes, and wherein 1, 2,3 or all 4 Y's are halogen such as chlorine or bromine, are particularly effective functional fluid additives, according to the above application. Also, halogen substituted selenophenes and tellurophenes can be employed having mixed halogen substituents, e.g., 1 or more of the Y's can be chlorine and one or more of the Y's in the same compound can be bromine. Further, mixtures of the above-defined selenophenes, or of the above-defined tellurophenes, or a combination of selenophenes and tellurophenes can be employed.

Specific examples of the above-defined selenophenes and tellurophenes which can be employed are as follows:

1. selenophene
2. tellurophene
3. 2-chloroselenophene
4. 3-chloroselenophene
5. 2,3-dichloroselenophene
6. 2,5-dichloroselenophene
7. 2,3,4-trichloroselenophene
8. 2,3,5-trichloroselenophene
9. tetrachloroselenophene
10. 2-chloro 3-bromoselenophene
11. 2,3-dichloro 4-bromoselenophene Specific examples of halogenated tellurophenes correspond to those of compounds (3) to (11) above, wherein selenium is replaced by tellurium.

Specific examples of brominated selenophenes are those corresponding to compounds (3) to (9) above, wherein chlorine in each of such compounds is replaced by bromine, and specific examples or brominated tellurophenes correspond to the above specific brominated selenophenes, wherein selenium is replaced by tellurium.

Selenophene and tellurophene compounds which have been found especially effective are tetrachloroselenophene, compound (9) above, and its tellurium analogue, tetrachlorotellurophene.

When employing the above-noted aryl selenide additives and the above selenophene or tellurophene additives for improving the flammability characteristics of the functional fluid, according to the invention, it is also desirable to include a small amount of a tertiary organic phosphine, e.g. in the form of a triaryl phosphine such as triphenyl phosphine, in the functional fluid to reduce or substantially eliminate the corrosive effect of the fluid containing such additive aryl selenide, or selenium or tellurium compounds, as described in U.S. Pat. Nos. 3,795,621 and 3,795,619, both of Martin B. Sheratte.

The tertiary organic phosphines employed as additives in combination with the above-described aryl selenide, selenophene and tellurophene additives, are phosphines having the general formula:

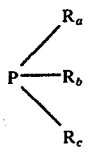

where $R_a$, $R_b$, and $R_c$ each can be aryl such as phenyl and naphthyl, and alkaryl such as cresyl, xylyl, ethyl phenyl, propyl phenyl, isopropyl phenyl, and the like, said aryl and alkaryl radicals preferably containing from 6 to about 8 carbon atoms. $R_a$, $r_b$, and $R_c$ can be the same or different. Specific examples of the above tertiary organic phosphine additives which can be employed according to the invention are the preferred triphenyl phosphine and dicresyl phenyl phosphine, additional examples of uitable phosphines being cresyl diphenyl phosphine, tricresyl phosphine, alpha-naphthyl-diphenyl phosphine and tris-(3,4-dimethylphenyl) phosphine.

For greatest effectiveness in substantially reducing the flammability, and for correspondingly substantially increasing the autoignition temperature of the functional fluid base stock hereof, it is usually desirable to employ only a small amount of the above aryl selenide, selenophene or tellurophene additive in the functional or hydraulic fluid. Generally, there can be employed as little as 0.1% and up to about 5% of the above aryl selenide, selenophene or tellurophene additive, preferably from about 0.1 to about 2% of such additive, in the functional fluid base stock, based on the weight of the composition.

The amount of tertiary organic phosphine additive incorporated in the functional fluid base stock together with the small amount of the above aryl selenide, selenophene or tellurophene additive, can range from about 0.1 to about 5% by weight of the composition. In preferred practice, however, there is employed an amount of such phosphine ranging from about 0.1 to about 2% by weight of the composition.

Examples of preparation of the above aryl selenides are described in above U.S. Pat. No. 3,730,897, examples of preparation of the above tetrachloroselenophene and tetrachlorotellurophene compounds are described in above U.S. Pat. No 3,730,898, and preparation of the above tertiary organic phosphines is described in above Pat. No. 3,795,621.

It will also be understood that other commonly employed additives such as corrosion inhibitors, oxidation inhibitors, stabilizers, metal deactivators, and the like, such as epoxides, dialkyl sulfides, benzothiazole, phenyl alpha naphthylamine and phenolic oxidation inhibitors, well knwon as functional fluid additives in the art, can also be incorporated in the functional fluid composition of the invention, in relatively small amounts, if desired.

The following are examples illustrating functional fluid compositions according to the invention, such examples being only illustrative and are not intended as limitative of the invention. In the examples below the term "AIT" means autoignition temperature, the autoignition temperature of the functional fluid compositions of the invention according to the examples below being determined in accordance with standard method of test for autoignition temperature in accordance with ASTM D 2155 procedure

EXAMPLE 1

The following mixture 1 containing a phosphate ester and a polyalkylene glycol diether was prepared.

| Components | Per cent by weight |
|---|---|
| n-butyl-methyl diether of polypropylene glycol (molecular | |

-continued

| Components | Per cent by weight |
|---|---|
| weight, about 700) marketed as "Ucon DLB 62E"by Union Carbide Chemical Company | 37 |
| n-butyl-methyl diether of polypropylene glycol (molecular weight about 1,000) marketed as "Ucon DLB-200E"by Union Carbide Chemical Company | 16 |
| tri-n-hexyl phosphate | 47 |
| | 100 |

The viscosity of the above mixture at −65° F., 100° F., and 210° F., was measured and the results noted below:

Table I

| MIXTURE I | |
|---|---|
| Temperatures (° F) | Viscosity (centistokes) |
| −65 | 3670 |
| 100 | 10.1 |
| 210 | 3.01 |

To the above mixture 1 was added 0.8% by weight of 4,4′-dichlorodiphenyl diselenide.

The resulting composition or mixture 2 had viscosity characteristics similar to mixture 1, but the AIT of mixture 2 containing the selenide of the present example was raised to about 870° F., compared to an AIT of less than 600° F., for mixture 1.

EXAMPLE 2

Mixture 2 of Example 1, containing the selenide additive has a minor corrosive effect on bronze, cadmium plate and iron after contact of the fluid with such metals at a temperature of about 325° F. for about 26 hours.

To another portion of mixture 2 is added 0.5% by weight of dicresyl phenyl phosphine. The resulting composition, mixture 3, under the same conditions of testing as noted above, has a substantially reduced and almost negligible corrosive effect on bronze, cadmium plate and iron, and the acid number of this fluid mixture 3 following testing is substantially less than that of mixture 2 following the above corrosivity tests thereof.

EXAMPLE 3

The following fluid composition, mixture 4, was prepared.

| | % by weight |
|---|---|
| tributyl phosphate | 80 |
| Jeffox OL-2700 | 20 |
| | 100 |

Jeffox OL 2700 is understood to be a polypropylene glycol monomethyl ether, m.w. about 3,000.

Mixture 4 above has an AIT <650° F.

Mixture 5 was prepared as follows:

| | % by weight |
|---|---|
| Mixture 4 | 99.2 |
| 4,4′-dichlorodiphenyl diselenide | 0.8 |
| | 100.0 |

Mixture 5 had an AIT of 800° F. as compared to the above noted AIT of <650° F. for mixture 4 in the absence of the selenide additive.

EXAMPLE 4

The following fluid composition, mixture 6, was prepared.

| | % by weight |
|---|---|
| tributyl phosphate | 70 |
| tricresyl phosphate | 10 |
| Ucon LB 1700 | 20 |
| | 100 |

Ucon LB 1700 is understood to be a polypropylene glycol monomethylether, m.w. about 1,800.

Mixture 6 had an AIT of <680° F.

Mixture 7 was prepared as follows:

| | % by weight |
|---|---|
| Mixture 6 | 99.2 |
| 4,4′-dichlorodiphenyl diselenide | 0.8 |
| | 100.0 |

Mixture 7 had an AIT of 820° F., substantially higher than the AIT of fluid mixture 6 in the absence of the selenide additive.

EXAMPLE 5

The following fluid composition, mixture 8, was prepared.

| | % by weight |
|---|---|
| tributyl phosphate | 50 |
| Santicizer 148 | 30 |
| Ucon LB 285 | 20 |
| | 100 |

Santicizer 148 is understood to be a mixed alkyl ($C_8$–$C_{13}$) diphenyl phosphate.

Ucon LB 285 is understood to be the copolymer of ethylene oxide and propylene oxide, monobutyl ether, having a molecular weight of about 1,000.

Mixture 8 had an AIT of 870° F.

Mixture 9 was prepared as follows:

| | % by weight |
|---|---|
| Mixture 8 | 98.5 |
| tetrachloroselenophene | 1.5 |
| | 100.0 |

Mixture 9 had an AIT of 920° F.

EXAMPLE 6

The following fluid composition, mixture 10, was prepared.

| | % by weight |
|---|---|
| tributyl phosphate | 50 |
| Santicizer 148 | 25 |
| Ucon LB 285 | 20 |
| Ucon 50HB 5100 | 5 |
| | 100 |

Mixture 10 had an AIT of 870° F.
Mixture 11 was prepared as follows:

| | % by weight |
|---|---|
| Mixture 10 | 98.8 |
| tetrachlorotellurophene | 1.2 |
| | 100.0 |

Mixture 11 had an AIT of 920 F.

EXAMPLE 7

The following are additional examples of functional fluids according to the invention:

| | % by weight Mixtures | |
|---|---|---|
| | 12 | 13 |
| di-n-butyl phenyl phosphate | | 15 |
| tri-n-hexyl phosphate | 60 | |
| tricresyl phosphate | | 25 |
| Ucon DLB-62E | 37 | |
| n-butyl ethyl diether of polypropylene glycol (mw. 800) | | 58.5 |
| ethyl p-chlorophenyl selenide | 2 | |
| tetrachlorotellurophene | | 1 |
| triphenyl phosphine | 1 | 0.5 |
| | 100 | 100 |

EXAMPLE 8

Compositions or mixtures 14 and 15 noted in Table II below, containing a phosphate ester or esters, a polypropylene glycol diether or diethers and additives were prepared in accordance with the invention.

The viscosity in centistokes at −65° F. and at 210 F., and also the density, of the respective compositions were measured.

The resulting compositions designated mixtures 14 and 15 are given in the table below, together with their respective density and viscosities at −65° F. and 210° F.

TABLE II

| Components | Examples of Compositions (% by weight) 14 | 15 |
|---|---|---|
| Ucon DLB-200E | 18 | 22.5 |
| Ucon DLB-62E | 15.5 | 19 |
| Dibutyl phenyl phosphate | 8 | — |
| Tri-n-hexyl phosphate | 55 | 55 |
| Additives | 3.5 | 3.5 |
| | 100.0 | 100.0 |
| Viscosity (cs.) | | |
| 65° F. | 2880 | 3980 |
| 210° F. | 3.70 | 3.22 |
| Density | 0.96 | 0.95 |

The term "additives" set forth in the table above includes epoxide stabilizer, about 1% 4,4'-dichlorodiphenyl diselenide and about 0.5% triphenyl phosphine, and water.

From the table above, it is seen that mixtures 14 and 15 containing a phosphate ester, or mixtures thereof, and a polypropylene glycol diether or mixtures thereof, of suitable molecular weight, each have viscosities at −65° F. ranging from 2880 to 3980 cs. and at 210° F. ranging from 2.70 to 3.22 cs, and essentially within the preferred viscosities of less than 4200 cs. at −65° F. and about 3.0 cs. at 210° F., and densities less than 1, and hence are relatively low density fluids, an important economic criterion for use of such fluids in modern large commercial aircraft, so that such compositions are particularly useful as functional or hydraulic fluids in aircraft.

The compositions 14 and 15 of the above table also have high fire resistance, and have good thermal and hydrolytic stability.

EXAMPLE 9

In Table III below is set forth additional illustrative compositions of the present invention.

In the table below Ucon 50HB 5100 is understood to be the copolymer of ethylene oxide and propylene oxide, monobutyl ether, molecular weight 4,000 – 5,000.

TABLE III

| | EXAMPLES OF COMPOSITIONS (% by weight) | | | | | | |
|---|---|---|---|---|---|---|---|
| | 16 | 17 | 18 | 19 | 20 | 21 | 22 |
| di-n-butyl phenyl phosphate | | | 45 | | 15 | | |
| tri-n-butyl phosphate | 25 | 40 | | 45 | | 50 | 40 |
| tri-n-hexyl phosphate | 25 | | | | | | |
| n-butyl diphenyl phosphate | 25 | | | | 25 | | |
| n-octyl diphenyl phosphate | | | | 25 | | | |
| triphenyl phosphate | | | | | | 15 | |
| dicresyl phenyl phosphate | | | 20 | | | | 15 |
| tricresyl phosphate | | 15 | | | | | 20 |
| Ucon DLB 62E | | | 23 | | | | 15 |
| Ucon LB 285 | 17 | 43 | | 18.5 | 37 | 25 | |
| Jeffox OL 2700 | | | 9 | | 20 | | 7.5 |
| Ucon 50HB 5100 | 6.2 | | | 10 | | 7 | |
| 4,4'-dichlorodiphenyl diselenide | 1.0 | | 2.5 | | | 2.2 | |
| ethyl p-chlorophenyl selenide | | 1.0 | | 1.0 | 2.0 | | 1.5 |
| triphenyl phosphine | 0.8 | 1.0 | 0.5 | 0.5 | 1.0 | 0.8 | 1.0 |

From the foregoing, it is seen that in accordance with the invention, functional fluids designed for industrial and marine use, and particularly for use as hydraulic fluids in jet aircraft, are provided in the form of a mixture of a phosphorus compound, preferably an aliphatic phosphate ester containing at least two alkyl groups, and a polyalkylene glycol material, preferably a polypropylene glycol ether, the phosphate ester most desirably being a combination of aliphatic and aromatic phosphates, and the polyalkylene glycol material most desirably being a combination of polyalkylene glycol ethers of low to medium molecular weight, and of high molecular weight, and including a small amount preferably of a chlorinated aryl selenide, or a chlorinated selenophene or tellurophene compound as described herein, such fluids having requisite viscosity characteristics at temperatures ranging from about −65° F. to about 210° F., permitting their use in aircraft hydraulic systems even in the absence of viscosity index improver, improved fire resistance, and improved thermal and hydrolytic stability, and which have reduced deleterious effect on non-metallic materials, e.g. reduced rubber swell on contact with rubber parts, and also improved shear stability and substantially reduced cost as compared to the conventional phosphorus ester base stocks.

While I have described particular embodiments of my invention for purposes of illustration, it will be understood that various changes and modifications within the spirit of the invention can be made, and the invention is not to be taken as limited except by the scope of the appended claims.

What is claimed is:

1. A functional fluid composition consisting essentially of (1) a phosphorus compound selected from the group consisting of phosphate esters and mixtures of said phosphate esters, said phosphate esters having the general formula:

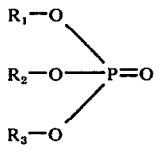

where $R_1$ and $R_2$ are each a member selected from the group consisting of alkyl of from about 3 to about 10 carbon atoms, and alkoxyalkyl having from about 3 to about 8 carbon atoms, and $R_3$ is a member selected from the group consisting of alkyl and alkoxyalkyl, as above defined, aryl and alkaryl, containing from 6 to about 8 carbon atoms, (2) a polyalkylene glycol material, said glycol material selected from the group consisting of a polypropylene glycol mono- or diether, and a mono- or diether of an ethylene-propylene copolymer, said mono- or diethers having at least one terminal oxyalkyl group wherein the alkyl radicals contain from 1 to about 4 carbon atoms, and mixtures thereof, said polyalkylene glycol material having a molecular weight ranging from about 500 to about 2,000, said phosphorus compound being present in an amount ranging from about 15 to about 90%, and said glycol material being present in an amount ranging from about 9 to about 84%, by weight of said composition, said phosphorus compound and said glycol material being present in amounts such that said composition has a viscosity at −65° F of not greater than about 6,000 centistokes, and a viscosity at 210° F of not less than 2.25 centistokes, and (3) a small amount of an additive compound sufficient to enhance the autoignition temperature of said composition, said additive compound selected from the class (a) having the general formulae:

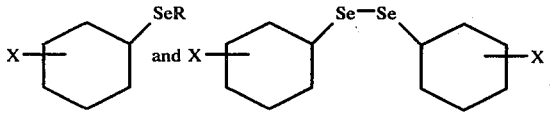

where X is selected from the group consisting of H, alkyl, halogen, alkoxy, amino and dialkylamino, and R is alkyl of from about 1 to about 12 carbon atoms, and (b) having the general formula

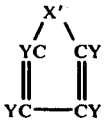

where X′ is a member selected from the group consisting of Se and Te, and Y is a member selected from the group consisting of H and a halogen.

2. A functional fluid composition as defined in claim 1, wherein said glycol material is selected from the group consisting of an n-butyl methyl diether of polypropylene glycol, and the copolymer of ethylene oxide and propylene oxide, monobutyl ether, said glycol material having a molecular weight ranging from about 600 to about 1,200.

3. A functional fluid composition consisting essentially of (1) a phosphorus compound selected from the group consisting of phosphate esters and amides of an acid of phosphorus, said phosphate esters containing at least two groups selected from the class consisting of alkyl and alkoxyalkyl, and mixtures of said phosphate esters, (2) a polyalkylene glycol material having terminal groups selected from the class consisting of free hydroxyl and ether groups, said ether groups being oxyalkyl groups wherein the alkyl radicals contain from 1 to about 8 carbon atoms, and mixtures of said glycol material, said alkylene groups being selected from the class consisting of ethylene and propylene radicals, and mixtures thereof, said polyalkylene glycol material having a molecular weight ranging from about 500 to about 25,000, said phosphorus compound and said glycol material being present in amounts such that said composition has a viscosity at −65° F of not greater than about 6,000 centistokes, and a viscosity at 210° F of not less than 2.25 centistokes, and (3) a small amount of an additive compound sufficient to enhance the autoignition temperature of said composition, said additive compound selected from the class (a) having the general formulae:

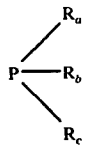

where X is selected from the group consisting of H, alkyl, halogen, alkoxy, amino and dialkylamino, and R is alkyl of from about 1 to about 12 carbon atoms, and (b) having the general formula

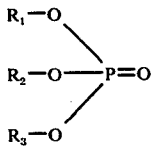

where X′ is a member selected from the group consisting of Se and Te, and Y is a member selected from the group consisting of H and a halogen, and (4) a small amount of a tertiary organic phosphine having the formula:

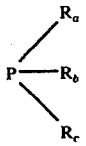

where $R_a$, $R_b$and $R_c$ are each a member selected from the group consisting of aryl and alkaryl.

4. A functional fluid composition as defined in claim 3, wherein X and Y in said additive compound are each halogen, and said additive compound is present in an amount ranging from about 0.1 to about 5% by weight, and wherein said phosphine is present in an amount ranging from about 0.1 to about 5% by weight.

5. A functional fluid composition consisting essentially of (1) a phosphorus compound selected from the group consisting of phosphate esters and mixtures of said phosphate esters, said phosphate esters having the general formula:

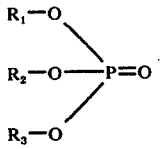

where $R_1$ and $R_2$ are each a member selected from the group consisting of alkyl of from about 3 to about 10 carbon atoms, and alkoxyalkyl having from about 3 to about 8 carbon atoms, and $R_3$ is a member selected from the group consisting of alkyl and alkoxyalkyl, as above defined, aryl and alkaryl, containing from 6 to about 8 carbon atoms, (2) a polyalkylene glycol material having terminal groups selected from the class consisting of free hydroxyl and ether groups, said ether groups being oxyalkyl groups wherein the alkyl radicals contain from 1 to about 8 carbon atoms, and mixtures of said glycol material, said alkylene groups being selected from the class consisting of ethylene and propylene radicals, and mixtures thereof, said polyalkylene glycol material having a molecular weight ranging from about 500 to about 25,000, said phosphorus compound being present in an amount ranging from about 15 to about 90%, and said glycol material being present in an amount ranging from about 9 to about 84%, by weight of said composition, said phosphorus compound and said glycol material being present in amounts such that said composition has a viscosity at −65° F of not greater than about 6,000 centistokes, and a viscosity at 210° F of not less than 2.25 centistokes, (3) a small amount of an additive compound sufficient to enhance the autoignition temperature of said composition, said additive compound being selected from the group consisting of ethyl p-chlorophenyl selenide, 4,4′-dichlorodiphenyl diselenide, tetrachloroselenophene and tetrachlorotellurophene, and wherein said additive compound is present in an amount ranging from about 0.1 to about 2% by weight, and (4) about 0.1 to about 2phosphine.

6. A functional fluid composition consisting essentially of (1) a combination of at least two phosphate esters, one of said phosphate esters containing at least two groups selected from the class consisting of alkyl and alkoxyalkyl, and mixtures thereof, and a second of said phosphate esters containing at least two aromatic groups selected from the class consisting of aryl and alkaryl groups, and mixtures thereof, (2) a combination of at least two polyalkylene glycol ethers containing terminal oxyalkyl groups wherein the alkyl radicals contain from 1 to about 8 carbon atoms, said alkylene groups being selected from the class consisting of ethylene and propylene radicals, one of said polyalkylene glycol ethers having a molecular weight ranging from about 500 to about 2,000, and a second of said polyalkylene glycol ethers having a molecular weight ranging from above 2,000 up to about 25,000, said phosphate esters and said polyalkylene glycol ethers being present in amounts such that said composition has a viscosity at −65° F. of not greater than about 6,000 centistokes, and a viscosity at 210° F. of not less than 2.25 centistokes, and (3) a small amount of an additive compound sufficient to enhance the autoignition temperature of said composition, said additive compound selected from the class (a) having the general formulae:

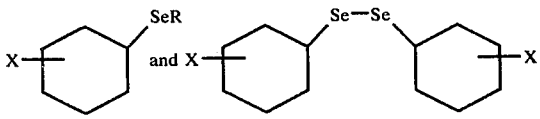

where X is selected from the group consisting of H. alkyl, halogen, alkoxy, amino and dialkylamino, and R is alkyl of from about 1 to about 12 carbon atoms, and (b) having the general formula

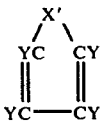

where X′ is a member selected from the group consisting of Se and Te, and Y is a member selected from the group consisting of H and a halogen.

7. A functional fluid composition as defined in claim 6, said one phosphate ester being present in an amount ranging from about 10 to about 80%, and said second phosphate ester being present in an amount ranging from about 5 to about 75%, said one polyalkylene glycol ether being present in an amount ranging from about 8 to about 65%, and said second polyalkylene glycol ether being present in an amount ranging from about 2 to about 25%, by weight of said composition.

8. A functional fluid composition as defined in claim 7, said one phosphate ester having the general formula:

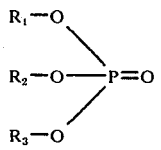

where $R_1$ and $R_2$ are each a member selected from the group consisting of alkyl of from about 3 to about 10 carbon atoms, and alkoxyalkyl having from about 3 to about 8 carbon atoms, and $R_3$ is a member selected from the group consisting of alkyl and alkoxyalkyl, as above defined, aryl and alkaryl, containing from 6 to about 8 carbon atoms, said second phosphate ester having the general formula:

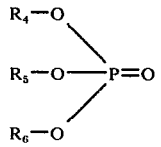

where $R_4$ and $R_5$ are each a member selected from the group consisting of aryl and alkaryl, containing from 6 to about 8 carbon atoms, and $R_6$ is a member selected from the group consisting of aryl and alkaryl, containing from 6 to about 8 carbon atoms, alkyl of from about 3 to about 20 carbon atoms, and alkoxyalkyl having from about 3 to about 8 carbon atoms.

9. A functional composition as defined in claim 8, wherein said one phosphate ester is selected from the group consisting of dialkyl aryl and trialkyl phosphates, and said second phosphate ester is selected from the group consisting of triaryl and alkyl diaryl phosphates.

10. A functional fluid composition as defined in claim 8, said polyalkylene glyco ethers selected from the group consisting of a polypropylene glycol mono- or diether, and a mono- or diether of an ethylene-propylene copolymer, said mono- or diethers having at least one terminal oxyalkyl group wherein the alkyl radicals contain from 1 to about 4 carbon atoms.

11. A functional fluid composition as defined in claim 10, said one polyalkylene glycol ether having a molecular weight ranging from about 600 to about 1,200, and said second polyalkylene glycol ether having a molecular weight ranging from about 3,000 to about 25,000.

12. A functional fluid composition as defined in claim 11, wherein said one phosphate ester is selected from the group consisting of dialkyl aryl and trialkyl phosphates, and said second phosphate ester is selected from the group consisting of triaryl and alkyl diaryl phosphates.

13. A functional fluid composition as defined in claim 12, said one phosphate ester being present in an amount ranging from about 10 to about 60%, and said second phosphate ester being present in an amount ranging from about 5 to about 40%, said one polyalkylene glycol ether being present in an amount ranging from about 10 to about 40%, and said second polyalkylene glycol ether being present in an amount ranging from about 4 to about 15%, by weight of said composition.

14. A functional fluid composition as defined in claim 12, wherein X and Y in said additive compound are each halogen, and said additive compound is present in an amount ranging from about 0.1 to about 5% by weight.

15. A functional fluid composition as defined in claim 12, said additive compound being selected from the group consisting of ethyl p-chlorophenyl selenide, 4,4′-dichlorodiphenyl diselenide, tetrachloroselenophene and tetrachlorotellurophene, and wherein said additive compound is present in an amount ranging from about 0.1 to about 2%, by weight.

16. A functional fluid composition as defined in claim 15, including about 0.1 to about 2% by weight of triphenyl phosphine.

17. A functional fluid composition as defined in claim 13, said one phosphate ester being selected from the group consisting of tributyl phosphate, dibutyl phenyl phosphate and tri-n-hexyl phosphate, and said second phosphate ester being selected from the group consisting of tricresyl phosphate, butyl diphenyl phosphate and tridecyl diphenyl phosphate.

18. A functional fluid composition as defined in claim 17, said polyalkylene glycol ethers being selected from the group consisting of the n-butyl methyl diether of polypropylene glycol, the monomethyl ether of polypropylene glycol, and the copolymer of ethylene oxide and propylene oxide, monobutyl ether.

19. A functional fluid composition as defined in claim 18, wherein both said one and said second polyalkylene glycol ethers are each a copolymer of ethylene oxide and propylene oxide, monobutyl ether.

20. A functional fluid composition as defined in claim 18, said additive compound being selected from the group consisting of ethyl p-chlorophenyl selenide, 4,4′-dichlorodiphenyl diselenide, tetrachloroselenophene and tetrachlorotellurophene, and wherein said additive compound is present in an amount ranging from about 0.1 to about 2%, by weight.

21. A functional fluid composition as defined in claim 20, including about 0.1 to about 2% by weight of triphenyl phosphine.

22. A functional fluid composition as defined in claim 6, including a small amount of a tertiary organic phosphine having the formula:

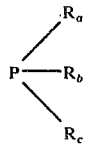

where $R_a$, $R_b$ and $R_c$ are each a member selected from the group consisting of aryl and alkaryl.

23. A functional fluid composition as defined in claim 22, wherein X and Y in said additive compound are each halogen, and said additive compound is present in an amount ranging from about 0.1 to about 5% by weight, and wherein said phosphine is present in an amount ranging from about 0.1 to about 5% by weight.

24. A functional fluid composition as defined in claim 22, wherein X and Y in said additive compound are each halogen, and said additive compound is present in an amount ranging from about 0.1 to about 2% by weight. and wherein said phosphine is present in an amount ranging from about 0.1 to about 2% by weight.

25. A functional fluid composition as defined in claim 6, wherein X and Y in said additive compound are each halogen, and said additive compound is present in an amount ranging from about 0.1 to about 5% by weight.

* * * * *

UNITED STATES PATENT OFFICE

CERTIFICATE OF CORRECTION

Patent No. 4,007,123 Dated February 8, 1977

Inventor(s) Martin B. Sheratte

It is certified that error appears in the above-identified patent and that said Letters Patent are hereby corrected as shown below:

On the Cover Sheet in the [*] Notice, "Feb. 11,1992" should read --- Mar. 5, 1991 ---.

Signed and Sealed this

Twenty-first Day of June 1977

[SEAL]

*Attest:*

RUTH C. MASON
*Attesting Officer*

C. MARSHALL DANN
*Commissioner of Patents and Trademarks*